US008403686B2

(12) United States Patent
Pizzi

(10) Patent No.: US 8,403,686 B2
(45) Date of Patent: Mar. 26, 2013

(54) CONDUCTING PART

(75) Inventor: Giordano Pizzi, Milan (IT)

(73) Assignee: Morsettitalia, S.p.A., Milan (IT)

( * ) Notice: Subject to any disclaimer, the term of this patent is extended or adjusted under 35 U.S.C. 154(b) by 120 days.

(21) Appl. No.: 13/009,527

(22) Filed: Jan. 19, 2011

(65) Prior Publication Data

US 2011/0177724 A1 Jul. 21, 2011

(30) Foreign Application Priority Data

Jan. 20, 2010 (IT) ..... MI2010A0060

(51) Int. Cl.
*H01R 25/00* (2006.01)

(52) U.S. Cl. ..... 439/111; 439/115; 439/532

(58) Field of Classification Search ..... 439/111, 439/115, 532
See application file for complete search history.

(56) References Cited

U.S. PATENT DOCUMENTS

| | | | | |
|---|---|---|---|---|
| 4,171,861 | A | 10/1979 | Hohorst | |
| 5,797,756 | A * | 8/1998 | Nad | 439/94 |
| 5,980,313 | A * | 11/1999 | Kunishi et al. | 439/545 |
| 6,425,770 | B1 * | 7/2002 | Lostoski et al. | 439/76.1 |
| 6,444,900 | B1 * | 9/2002 | Casey | 174/358 |
| 6,628,515 | B2 * | 9/2003 | Chen et al. | 361/679.33 |
| 6,722,918 | B2 * | 4/2004 | McCoy | 439/533 |
| 7,156,694 | B1 * | 1/2007 | Anderson | 439/535 |
| 7,862,389 | B2 * | 1/2011 | Pizzi | 439/715 |

FOREIGN PATENT DOCUMENTS

| | | | |
|---|---|---|---|
| DE | 2914192 | A1 | 10/1980 |
| DE | 19729327 | C1 | 10/1998 |
| DE | 10100201 | A1 | 7/2001 |
| DE | 20303475 | U1 | 5/2003 |
| DE | 102008009986 | A1 | 7/2009 |
| EP | 1883132 | A1 | 1/2008 |
| EP | 1953869 | A2 | 8/2008 |
| FR | 1593558 | A | 6/1970 |

OTHER PUBLICATIONS

Italian Search Report from MI20100060 dated Aug. 3, 2010.

* cited by examiner

*Primary Examiner* — Truc Nguyen
(74) *Attorney, Agent, or Firm* — Mintz, Levin, Cohn, Ferris, Glovsky and Popeo, P.C.

(57) ABSTRACT

An electrical conducting part including a body including a cross-section substantially in the form of an overturned "U" having a longitudinal base, wherein at least one end of the body includes a longitudinal extension with an upwards fold, and a vertical flank, wherein the body defines at least one first opening elongated in the transverse direction and at least first elastic lugs extending in the vertical direction and integral with the flanks of the "U" and arranged in the longitudinal direction opposite each opening in the base.

18 Claims, 3 Drawing Sheets

300
312
10
11
12
11a
1
20

IV 2
112
110
120
122
22

400
412
VIII
IX

CONDUCTING PART

CROSS-REFERENCE TO RELATED ACTIONS

This application claims the benefit of and priority to Italian Patent Application No. MI2010A 60, filed Jan. 20, 2010, which is incorporated by reference herein in its entirety.

BACKGROUND

In the technical sector relating to the manufacture of switchboards for the wiring of electrical installations, terminal blocks can be designed to be mounted on corresponding support rails and to provide frontal access to the means for retaining, normally via a screw, the electrical connection wires that form the electric circuit. In order to be able to limit the overall dimensions of the terminal block, it can be desirable to make the internal conducting part, which connects the input to the output of the terminal block, from a material with a high electrical conductivity, such as copper or the like, since the small dimensions of the assembly would otherwise be unable to withstand the necessary electrical load. On the other hand, the high cost of said conducting materials can result in the need to limit the size of the terminal block, and therefore its rated electric load, in order to avoid excessively high production and distribution costs.

EP 1,883,132 and EP 1,953,869, in the name of the same present Applicants, disclose both a conducting part which has a "U" shape with longitudinal extensions provided with means for fixing the actual electric wires as well as holes for inserting the means for connecting together several terminal blocks in parallel or slits for inserting the flat pins of fuse-holder parts, or flat conducting parts provided with elastic jaws able to receive flat pins of fuse-holder parts, and a terminal block for connecting electric wires and fused isolators comprising an insulating body and a conducting part, as described above, housed inside it. Although performing their function, these devices are typically formed using a high number of component parts that can, in turn, require several machining operations producing a large amount of machining waste. In addition, existing terminal blocks can have large dimensions in the vertical direction, which can represent a constraint when mounting the terminal blocks in small available spaces.

SUMMARY

One or more embodiments of the present invention relate to a conducting part in the form of an overturned "U" incorporating means for inserting, making electrical contact with and retaining contact terminals of electric devices and to a terminal block for connecting electric wires comprising said conducting part.

One technical problem that can be addressed by one or more embodiments of the present invention is, therefore, to provide a conducting part for connecting and/or isolating terminal blocks that can be combined with electrical devices having contact elements in the form of flat pins, which provides a solution to the problems of the known art, being easy and inexpensive to produce and assemble as well as suitable for allowing the production of terminal blocks which have small dimensions in the vertical direction and can be standardized for all types of use.

In general, in an aspect, embodiments of the invention can provide an electrical conducting part including a body including a cross-section substantially in the form of an overturned "U" having a longitudinal base, wherein at least one end of the body includes a longitudinal extension with an upwards fold, and a vertical flank, wherein the body defines at least one first opening elongated in the transverse direction and at least first elastic lugs extending in the vertical direction and integral with the flanks of the "U" and arranged in the longitudinal direction opposite each opening in the base.

Implementations of the invention can provide one or more of the following features. The base of the "U" has a longitudinal extension with an upwards fold at both opposite ends. The base of the "U" includes a second seat extending in the longitudinal direction and arranged on the opposite side to the longitudinal end extension relative to the first transverse seat such that each flank of the "U" has opposite the second longitudinal seats in the longitudinal direction a pair of elastic lugs extending in the longitudinal direction, said lugs being arranged facing each other and folded in the transverse direction towards the inside of the "U". The elastic lugs are punched along the flanks.

In general, in another aspect, embodiments of the invention can provide a terminal block including an insulating body formed in the manner of a skeleton structure including a front surface having opposite longitudinal ends, extending from the longitudinal opposite ends of the front surface, a respective turret, the turrets being arranged facing each other, defining an open space and an inner longitudinal seat, and have a respective inclined seat, the seats being configured to stably house a conducting part in the form of an overturned "U" according to Claim 1.

Implementations of the invention can provide one or more of the following features. The terminal block further includes a dividing wall that extends upwards from at least one longitudinal edge of the longitudinal seat in the vertical direction, joining together the inner faces of the two turrets in the longitudinal direction and further defining the open space in the transverse direction, the dividing wall comprising a through-hole in the transverse direction and two opposite vertical incisions. The vertical incisions have a depth configured to isolate a transverse bridge-piece. Each turret has at least one respective front side and at least one respective flank which have, defined therein, respective openings in the vertical direction and in the longitudinal direction that are configured to connect said turrets with the exterior. The terminal block is configured as a connector that is configured to internally house an electrical conducting part according to Claim 1. The terminal block further includes two conducting parts according to Claim 3 housed opposite each other inside the inner longitudinal seat. The terminal block further includes a device with flat contact terminals configured to isolate an electrical line.

Implementations of the invention can also provide one or more of the following features. The isolating device is configured to rotate about a pin inserted inside the hole of the dividing wall and has a curved flat contact terminal. The isolating device has flat pins for insertion by rectilinear displacement. The terminal block further includes a protection device with flat pins. The flat pins are straight for insertion by displacement inside the seats of the conducting part. The protection device is a fuse holder. The terminal block is configured as an grounding connector. The terminal block further includes a flat plate suitable for mating with the longitudinal lugs of the electrical conducting part and provided with hook-shaped parts for engagement with a support rail so as to form the ground terminal of the terminal block.

These results can preferably be achieved using one or more of the features described herein in the following figures, detailed description, and claims.

DETAILED DESCRIPTION

Figures 1, 2, 3, 4, 5, 6, 7, 8, 9:
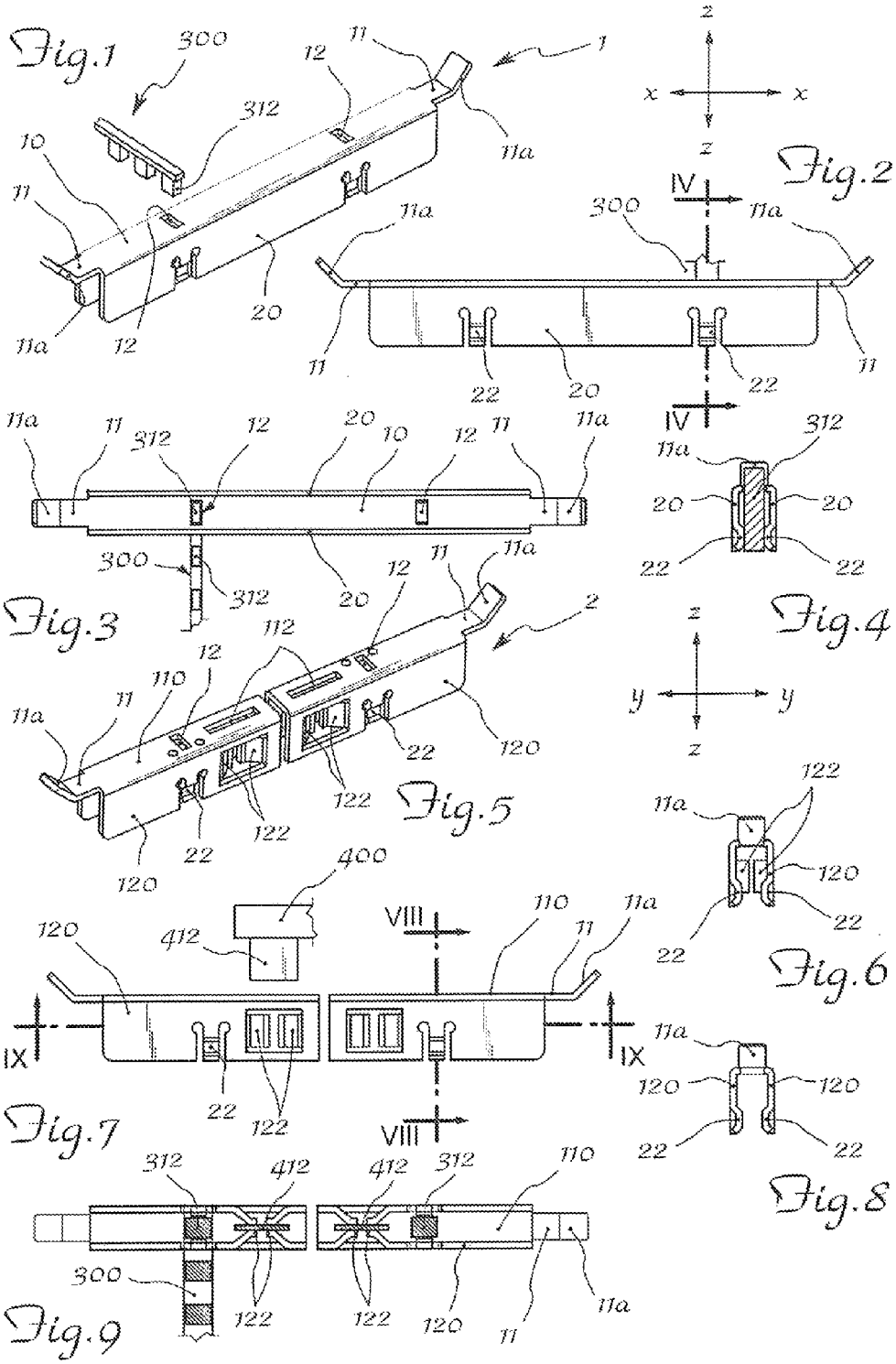
FIG. 1 is a perspective view of a conducting part.
FIG. 2 is a side view of the conducting part according to FIG. 1.
FIG. 3 is a bottom view of the conducting part according to FIG. 1.
FIG. 4 is a cross-section along the plane indicated by the line IV-IV in FIG. 2.
FIG. 5 is a perspective view of a conducting part.
FIG. 6 is a front view of the conducting part according to FIG. 5.
FIG. 7 is a side view of the conducting part according to FIG. 5.
FIG. 8 is a cross-section along the plane indicated by the line VIII-VIII in FIG. 7.
FIG. 9 is a cross-section along the plane indicated by the line IX-IX in FIG. 7.

Referring to FIG. 1 and assuming solely for the sake of simplification of the description and without any limitation of meaning a set of three reference axes in a longitudinal direction X-X, transverse direction Y-Y and vertical direction Z-Z, the conducting part 1 according to the present invention comprises a body elongated in the longitudinal direction X-X and having a cross-section substantially in the form of an "overturned U" with longitudinal base 10 and vertical flanks 20.

The base 10 preferably has opposite ends provided with longitudinal extensions 11 having an upwards fold 11*a* and suitable for insertion inside a corresponding seat 514 of a terminal block 500 (FIG. 10) for stable mutual engagement. The base 10 can also have, formed therein, first openings 12 (in the example, two in number) that are preferably elongated in the transverse direction Y-Y and suitable for the insertion of corresponding teeth 312 of transverse electrical bridge-pieces 300 schematically shown in FIG. 1.

Each flank 20 of the conducting part preferably has first elastic lugs 22 that can be integral with the flanks themselves and can be arranged opposite each opening 12 in the base 10 along the longitudinal direction X-X. Preferably, the lugs 22 are formed by means of punching of the flanks 20 before the latter are folded to form the "U". With this configuration, upon insertion in the vertical direction Z-Z of the tooth 312 of the bridge-piece 300 inside the respective seat 12 of the base 10 of the "U", a forced-fitting electrical contact can be obtained by the elasticity of the lugs 22 which react in the transverse direction Y-Y towards the inside in response to the elastic deformation caused by the tooth 312.

FIG. 5 shows a further embodiment of the conducting part 2 in the form of an "overturned U", which has a base 110 with a single longitudinal extension 11 having a fold 11*a* and first elastic lugs 22, as in the first embodiment already described. The second embodiment preferably has a base 110 provided with a second seat 112 extending in the longitudinal direction X-X and arranged on the opposite side to the longitudinal extension 11 relative to the first transverse seat 12. Opposite said second longitudinal seats 112, each flank 120 of the "U" preferably has a pair of elastic lugs 122 extending in the longitudinal direction X-X and folded in the transverse direction Y-Y towards the inside of the "U". The lugs 122 can also be formed by means of punching of the flanks 20 before the latter are folded to form the "U" and can also use the same stroke that simultaneously forms the first vertical lugs 22. With this configuration it is possible to insert, in the vertical direction Z-Z, a flat pin 412 of an electrical device 400 inside the respective seat 112 of the base 110 of the "U", thereby preferably achieving at the same time an electrical contact resulting from the elastic reaction of the opposite lugs 122 which, deformed by the insertion of the flat pins 412, react elastically in the transverse direction Y-Y towards the inside of the "U".

Figure 10:
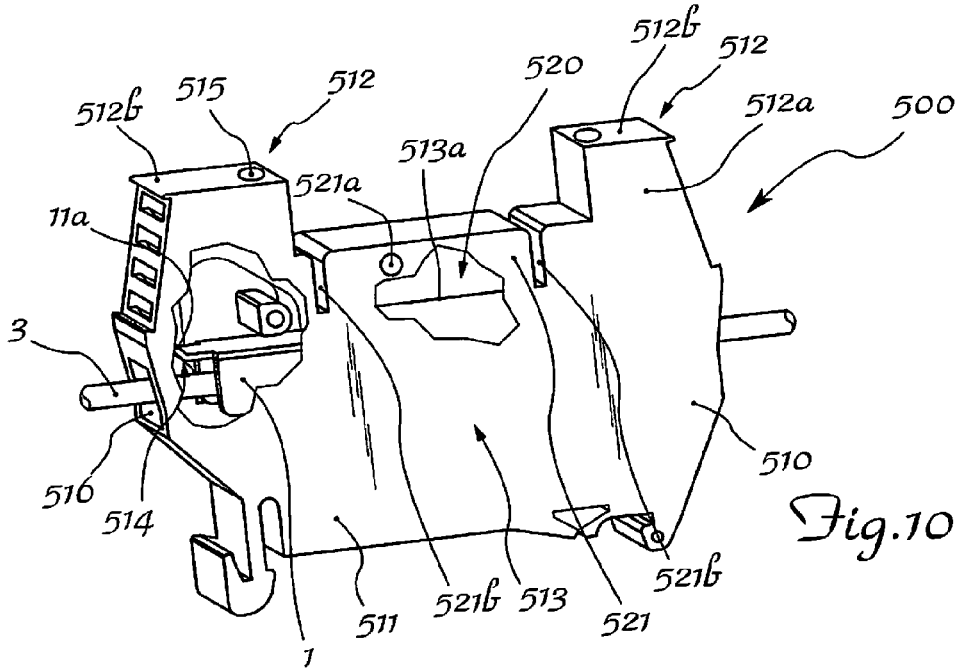
FIG. 10 is a perspective view of a terminal block.

As shown in FIG. 10, it is possible to produce terminal blocks 500 that have an insulating body 510 formed in the manner of a skeleton structure 511, the top part of which can include, at the opposite longitudinal ends, a respective turret 512. Preferably, the turrets 512 are arranged opposite each other to define an internal longitudinal seat 513 suitable for housing a conducting part in the form of an "overturned U" 1,2 according to, for example, various embodiments of the present invention. The longitudinal extensions 11,11*a* can be configured to be received inside corresponding inclined seats 514 formed inside the turrets 512.

Above said seat 513, the turrets 512 also preferably define an open space 520. From one of the longitudinal edges 513*a* of the seat 513, a dividing wall 521 preferably extends upwards in the vertical direction Z-Z and joins together in the longitudinal direction the inner faces of the two turrets 512, defining the open space 520 in the transverse direction Y-Y. The dividing wall 521 preferably comprises a through-hole 521*a* in the transverse direction Y-Y and two vertical incisions 521*b* formed on the opposite sides of the hole 521*a*. Each turret 512 preferably has at least one respective front side 512*a* and at least one respective flank 512*b* with corresponding respective openings 515 formed therein in the vertical direction Z-Z, for insertion of a tool for operating the spring or screw type means for fixing the electric wires 3, and openings 516 in the longitudinal direction Y-Y for insertion of an electric wire 3.

As shown in FIGS. 11 to 15 with the same body 500, it is possible to provide different types of terminal blocks according to the present invention, such as, i) a connector 600 (FIG. 11) housing internally a single-body conducting part 1 according to the first embodiment described, and ii) isolators 700 (FIGS. 12,13) containing two conducting parts 2 arranged opposite each other according to the other embodiment described.

The isolator 700 can, in turn, include i) a body 710 rotating about a pin 710*a* inserted inside the hole 521*a* of the dividing wall 521 and supporting a single curved terminal 711 which, rotating inside the seat 112, comes into contact with the elastic lugs 122 of both the electrical conducting parts 2, closing the circuit, and ii) a body 720 (FIG. 13) provided with two straight flat-pins 721 for insertion, by means of displacement, inside the respective seat 112 of the electric conducting parts 2.

Figure 14:
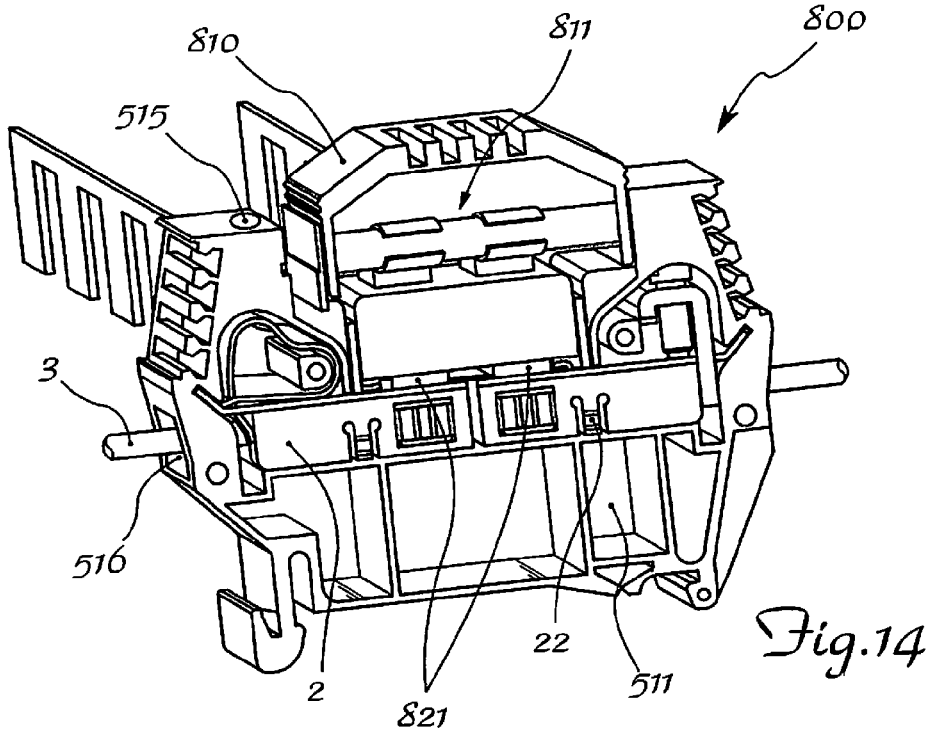
FIG. 14 is a protection terminal block with fuse-holder device with straight insertion means.

FIG. 14 shows a further possibility for use of the body 500 for forming connectors 800 protected by means of glass fuse-holder cases 810, shown by way of example in the figure with straight flat-pins 821 that preferably engage inside the respective longitudinal seats 112 by means of rectilinear displacement. Although not shown, the protected connector 800 could also be of the rotating type as described further above in the relation to the isolator. It is also envisaged that that protection can be provided by means of glass fuses, car fuses or thermal devices.

Figure 15:
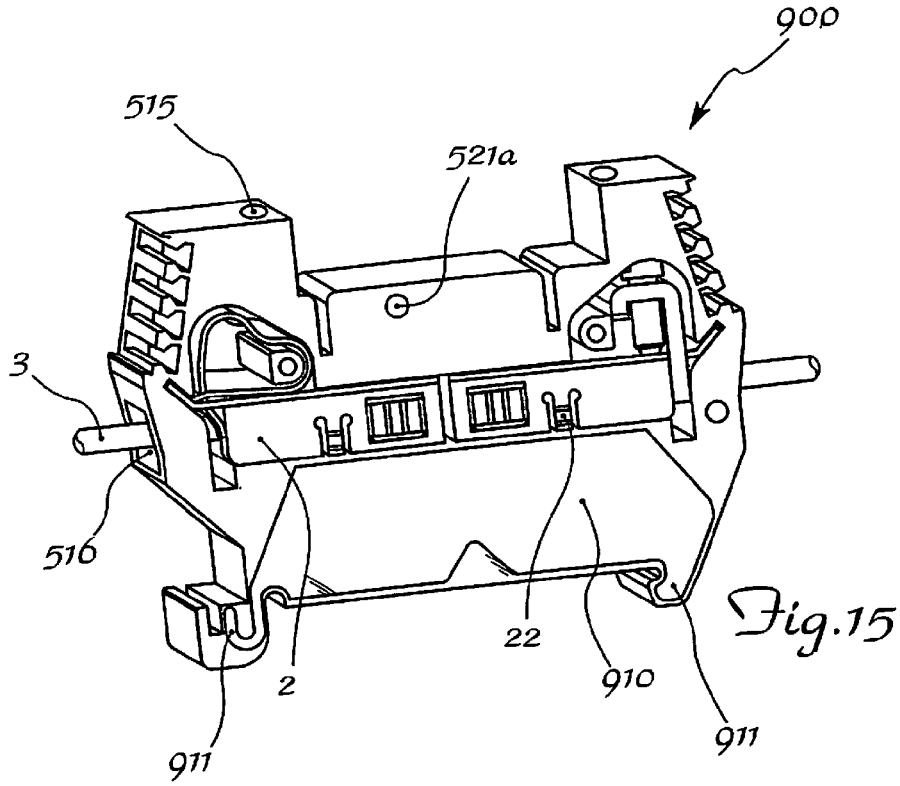
FIG. 15 is an grounding terminal block.

FIG. 15 shows an grounding connector 900 provided with a flat plate 910 with hooks 911 for engagement with the support rail and forming the ground terminal of the device for grounding the rail itself by means of, for example, corresponding ground wires 3. The flat plate can be inserted between the longitudinal elastic lugs 122 by means of insertion in the vertical direction Z-Z on the open side of the "U". The grounding terminal block can also have available transverse seats 12 for inserting the transverse bridge-piece 300.

Figure 11:
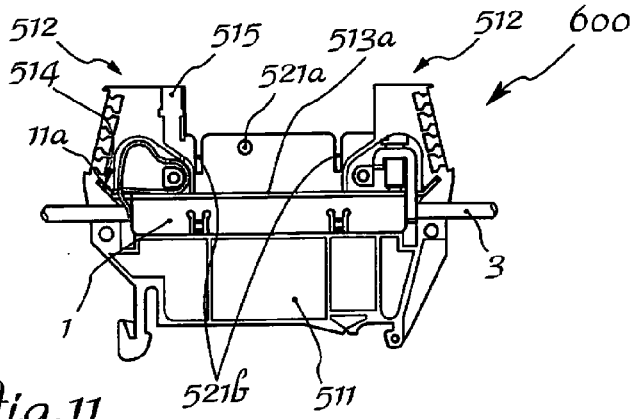
FIG. 11 is a side view of a terminal block for connection with the conducting part.
Figure 12:
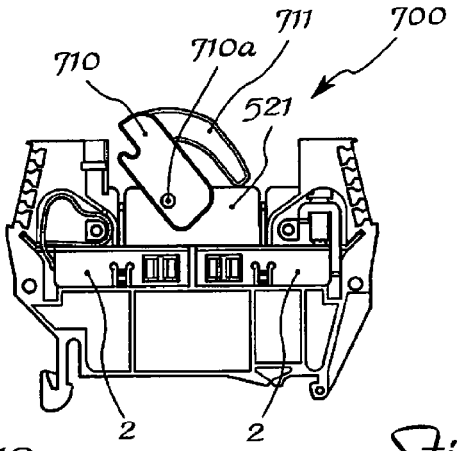
FIG. 12 is a side view of an isolating terminal block with conducting part and a rotational connecting device.
Figure 13:
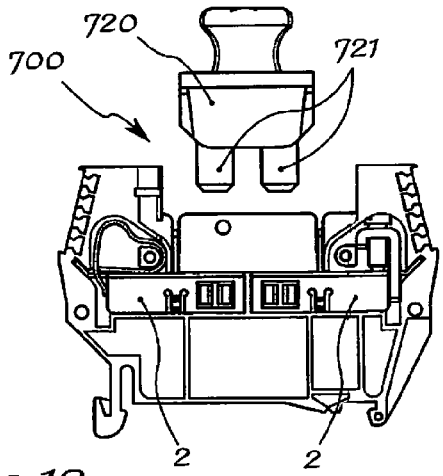
FIG. 13 is a side view of an isolator with conducting part and a connection device with straight insertion means.

FIGS. 11 and 12 also show the insertion of the transverse bridge-pieces 300 which, entering inside the vertical incisions 521*b* of the dividing wall 521, preferably penetrate with the teeth 312 inside the respective transverse seat 12 of the base 10,110 of the "U". Each conducting part can also be configured for fixing the end 3*a* of the electric wire 3, which can be in the form of an endless shaped spring or a screw-type terminal. Both the fixing devices can be operated by, for example, means of a tool coaxially inserted inside the vertical hole 515 communicating with the exterior.

The vertically open seat situated between the two opposite turrets preferably also allows insertion depthwise of the auxiliary devices 300,400,700 and therefore the formation of terminal blocks that can have small vertical dimensions, also allowing the manufacture of said insulating bodies in a single format which, in view of the mass-production method used, can result in significantly lower costs for production, storage, and management of stock.

In addition to the above, the embodiments of the conducting part and terminal block described herein can also result in further significant advantages since, owing to, for example, the presence of the elastic lugs 22,122, the connecting bridge-piece 300 can be formed by a simple flat part since the elastic force required for the electrical connection is already provided by the lugs incorporated in the conducting part 1,2. In addition to this, the transverse bridge-piece 300 does not require any insulating protection since it is embedded within the insulating body of the terminal block by means of the vertical incisions 521*b* in the dividing wall 521.

Other embodiments are within the scope and spirit of the invention. For example, features implementing functions may also be physically located at various positions, including being distributed such that portions of functions are implemented at different physical locations.

Further, while the description above refers to the invention, the description may include more than one invention.

What is claimed is:

1. An electrical conducting part comprising:

a body including a cross-section substantially in the form of an overturned "U" having a longitudinal base, wherein at least one end of the base includes a longitudinal extension with an upwards fold, and wherein at least one end of the base includes a vertical flank extending in a vertical direction, wherein the body defines at least one first opening in the base, each opening being elongated in the transverse direction and wherein the body defines at least first elastic lugs extending in the vertical direction and integral with the vertical flanks of the "U", each elastic lug arranged in the longitudinal direction opposite at least one of the first opening in the base.

2. The electrical conducting part according to claim 1, wherein the base of the "U" has a longitudinal extension with an upwards fold at both opposite ends.

3. The electrical conducting part according to claim 1, wherein the base of the "U" includes a second seat extending in the longitudinal direction and arranged on the opposite side to the longitudinal end extension relative to the first transverse seat such that each flank of the "U" has opposite the second longitudinal seats in the longitudinal direction a pair of elastic lugs extending in the longitudinal direction, the lugs being arranged facing each other and folded in the transverse direction towards the inside of the "U".

4. The electrical conducting part according to claim 1, wherein the elastic lugs are punched along the flanks.

5. A terminal block comprising:

an insulating body formed in the manner of a skeleton structure including a front surface having opposite longitudinal ends, extending from the longitudinal opposite ends of the front surface, a respective turret, the turrets being arranged facing each other, defining an open space and an inner longitudinal seat, and have a respective inclined seat, the seats being configured to stably house a conducting part in the form of an overturned "U" according to claim 1.

6. The terminal block according to claim 5, further comprising a dividing wall that extends upwards from at least one longitudinal edge of the longitudinal seat in the vertical direction, joining together the inner faces of the two turrets in the longitudinal direction and further defining the open space in the transverse direction, the dividing wall comprising a through-hole in the transverse direction and two opposite vertical incisions.

7. The terminal block according to claim 5, wherein the vertical incisions have a depth configured to isolate a transverse bridge-piece.

8. The terminal block according to claim 5, wherein each turret has at least one respective front side and at least one respective flank which have, defined therein, respective openings in the vertical direction and in the longitudinal direction that are configured to connect the turrets with the exterior.

9. The terminal block according to claim 5, wherein the terminal block is configured as a connector that is configured to internally house an electrical conducting part according to claim 1.

10. The terminal block according to claim 5, further comprising two conducting parts according to claim 3 housed opposite each other inside the inner longitudinal seat.

11. The terminal block according to claim 10, further comprising a device with flat contact terminals configured to isolate an electrical line.

12. The terminal block according to claim 11, wherein the isolating device is configured to rotate about a pin inserted inside the hole of the dividing wall and has a curved flat contact terminal.

13. The terminal block according to claim 11, wherein the isolating device has flat pins for insertion by rectilinear displacement.

14. The terminal block according to claim 10, further comprising a protection device with flat pins.

15. The terminal block according to claim 14, wherein the flat pins are straight for insertion by displacement inside the seats of the conducting part.

16. The terminal block according to claim 14, wherein the protection device is a fuse holder.

17. The terminal block according to claim 10, wherein the terminal block is configured as an grounding connector.

18. The terminal block according to claim 17, further comprising a flat plate suitable for mating with the longitudinal lugs of the electrical conducting part and provided with hook-shaped parts for engagement with a support rail so as to form the ground terminal of the terminal block.

* * * * *